US005193452A

United States Patent [19]

Dieperink

[11] Patent Number: 5,193,452

[45] Date of Patent: Mar. 16, 1993

[54] FOLDING PRESS WITH DEFLECTION COMPENSATING MEANS

[76] Inventor: Willem Dieperink, A l'Essert, Buchillon, Switzerland

[21] Appl. No.: 675,898

[22] PCT Filed: Sep. 11, 1990

[86] PCT No.: PCT/CH90/00217

§ 371 Date: May 10, 1991

§ 102(e) Date: May 10, 1991

[87] PCT Pub. No.: WO91/03371

PCT Pub. Date: Mar. 21, 1991

[30] Foreign Application Priority Data

Sep. 11, 1989 [CH] Switzerland ..... 3298/89

[51] Int. Cl.[5] ..... B30B 15/24

[52] U.S. Cl. ..... 100/46; 72/389; 100/99; 100/258 A

[58] Field of Search ..... 100/46, 99, 258 R, 258 A; 72/389, 447

[56] References Cited

U.S. PATENT DOCUMENTS

| | | | |
|---|---|---|---|
| 3,550,425 | 12/1970 | Cailloux | 100/258 A X |
| 3,677,009 | 7/1972 | Thatcher . | |
| 3,914,975 | 10/1975 | Kawano | 100/258 A X |
| 4,016,742 | 4/1977 | Shiokawa | 72/389 X |
| 4,408,520 | 10/1983 | Wons et al. | 100/46 X |
| 4,449,389 | 5/1984 | Cros | 100/46 X |
| 4,732,032 | 3/1988 | Kogure | 100/46 X |

FOREIGN PATENT DOCUMENTS

| | | | |
|---|---|---|---|
| 1703297 | 2/1972 | Fed. Rep. of Germany | 100/46 |
| 1200920 | 12/1959 | France | 100/46 |
| 1586274 | 2/1970 | France | 100/46 |
| 2357365 | 2/1978 | France | 100/46 |
| 2498122 | 7/1982 | France | 100/46 |
| 56-114600 | 9/1981 | Japan | 100/46 |
| 59-193718 | 11/1984 | Japan | 100/46 |
| 62-244600 | 10/1987 | Japan | 100/99 |
| 653289 | 12/1985 | Switzerland | 100/46 |
| 1586668 | 3/1981 | United Kingdom . | |

*Primary Examiner*—Harvey C. Hornsby
*Assistant Examiner*—Stephen F. Gerrity
*Attorney, Agent, or Firm*—Jacobson, Price, Holman & Stern

[57] ABSTRACT

The upper and lower frames of a folding press include a deflector capable of producing a deflection of at least one portion of a press member. A comparison device is provided which includes two longitudinal bars arranged, respectively, in longitudinal housings of each of the upper and lower frames. One of the ends of each of the bars is secured to its respective housing, the other end of each of the bars being free to move longitudinally in the housings and being connected to a measuring device respectively fixed to each of the upper and lower frames, so as to measure the respective movements of the other ends of the bars in their respective housings in response to any deflection of the upper and lower frames. The comparison device is arranged for controlling the deflector to compensate for any difference in deflection of the frames.

6 Claims, 2 Drawing Sheets

FOLDING PRESS WITH DEFLECTION COMPENSATING MEANS

FIELD OF THE INVENTION

The invention relates to a folding press comprising an upper frame and a lower frame, at least one of the frames comprising at least one deflection means of at least one portion of at least one press member to remedy the deficiencies inherent to the folding process.

BACKGROUND OF THE INVENTION

During the folding with a folding press, deflections occur inside the two frames, these deflections being the more important as the dimensions of the press are important. These deflections depend, in particular, on the shape, the dimensions and the quality of the material to fold, and they are generally not identic for both frames. In particular, when folding a piece, the upper frame has a tendency to bend upwards under the effect of the thrust of the working cylinder pistons, generally arranged at each of the ends of the press, leading to a longitudinal upwards deflection of the surface of the upper die holder. Similarly, the lower frame has a tendency to bend downwards leading to a downwards longitudinal deflection of the surface of the lower die holder. As a result, the respective working surfaces of the two frames and, therefore, of the dies are no longer parallel. The depth of penetration of the male die into the female die will then no longer be the same over the whole length of the press. It follows that the folding angle obtained is not the same over the whole length of the piece which is folded.

In order to remedy these difficulties, certain folding presses comprise compensation cylinders placed in one or both of the frames and arranged to compensate for the deflections due to the working of the press and to obtain, in particular, similar deflections of the upper and lower frames. However, these systems require a great number of trials for adjustment and most of them require the user to determine in advance the deflection due to the operation of the press.

SUMMARY OF THE INVENTION

The object of the invention is to remedy the above inconvenience by proposing a folding press in which the depth of penetration of the male die into the female die remains constant over the whole folding length without requiring a preliminary adjustment of the press.

To this effect, the invention relates to a folding press comprising an upper and a lower frame, at least one of the frames comprising at least one means for deflecting at least a portion of at least one member of the press to remedy to the deficiency inherent to the folding process.

BRIEF DESCRIPTION OF THE DRAWINGS

The invention will be better understood with the help of the following description of an example of a folding press according to the invention, given by way of example and with reference to the drawing in which.

DETAILED DESCRIPTION OF THE PREFERRED EMBODIMENTS

Figure 1:
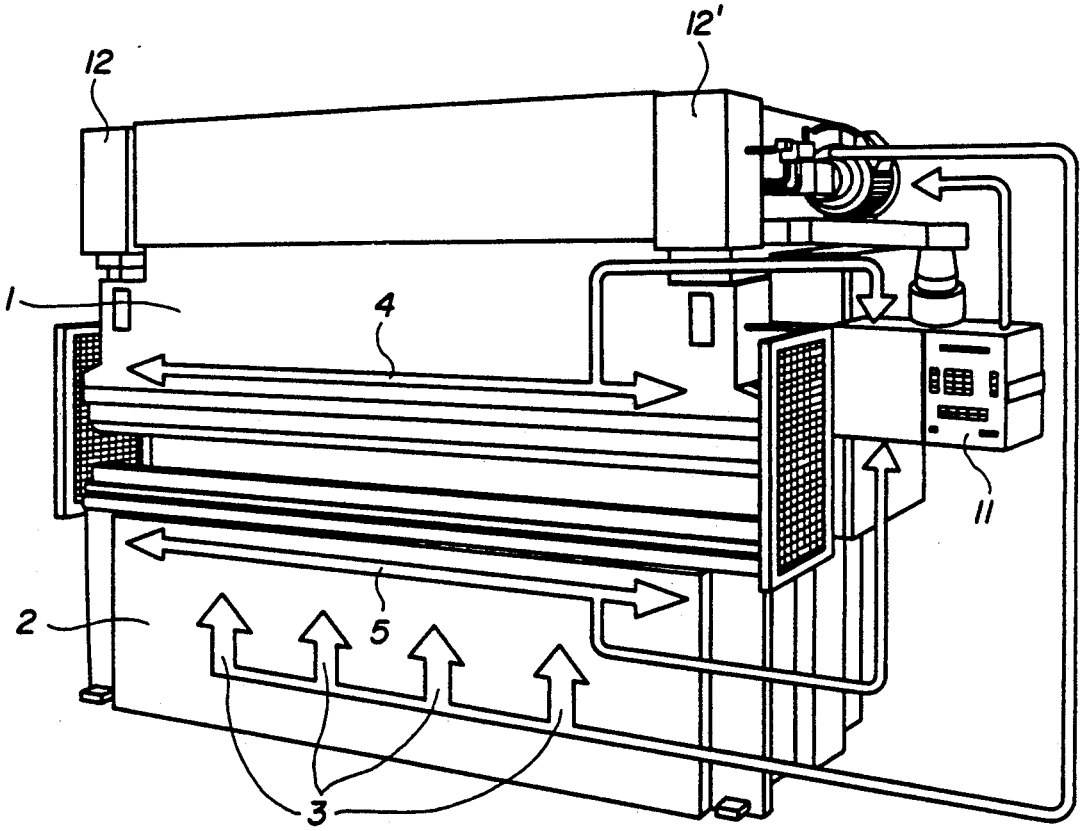
FIG. 1 is a schematic functional perspective view of an example of a folding press according to the invention.

The folding press shown in FIG. 1 comprises an upper frame 1 supporting a male die and a lower frame 2 supporting a female die. The lower frame comprises a plurality of compensation cylinders 3 used to compensate the deflections inherent to the folding process. The action of this compensation cylinders is controlled by an electronic device 11, such as a numerical control device. The comparison device for the deflection of each of the frames comprises longitudinal measuring means 4, 5 used to measure the elongation of said frames under deflection, said means being connected to the numerical control device 11.

Figure 2:
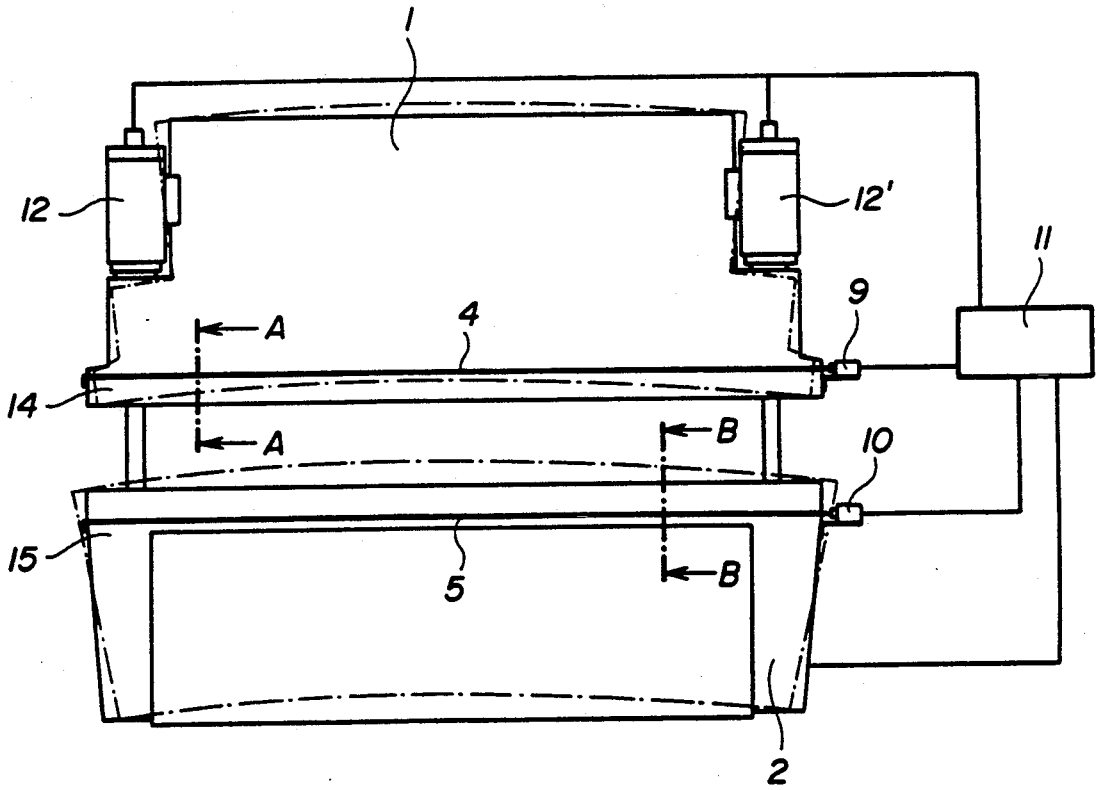
FIG. 2 is a partial front view of the press showing an embodiment of the comparison device for the deflection of the upper and lower frames.

According to an embodiment of the comparison device shown in FIG. 2, each of the frames comprises two longitudinal bars 4, 5 arranged, respectively, in housings 6, 7 provided, respectively, in the upper frame and in the lower frame. The upper bar 4 is merely placed in the housing 6. It is secured to the upper frame by a fixing means 14 attached to one of its ends. When any deflection of the upper frame occurs, the other end of the bar, which is free, can thus move freely with respect to the housing 6. This other end of the bar is fixed to a measuring means 9, such as for example a linear inductive sensor mounted on the upper frame at the end of the housing 6. Similarly, the lower bar 5 is merely placed in the housing 7. One of its ends is fixed to the lower frame by a fixing means 15. A second measuring means 10, similar to the measuring means 9, is mounted on the lower frame at the end of the housing 7 and is connected to the second end of bar 5.

Both sensors 9 and 10 are connected to the numerical control device 11 which is, in particular, adapted to receive the signals delivered by each of the sensors 9 and 10 upon any deflection of the upper and lower frames, for receiving said signals and for controlling automatically the operation of the compensation cylinders 3 until, at the output of sensor 10, signals are obtained which are equal to those obtained at the output of sensor 9. At this moment, as shown in FIG. 2 by dotted dashed lines, the surfaces of the two die holders of the upper and lower frames are parallel. The depth of penetration of the male die into the female die will then be constant over the whole folding length.

Figure 3:
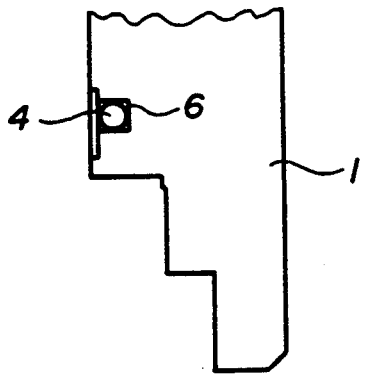
FIG. 3 is a partial section along A—A of the upper frame of the press of FIG. 2.

As shown in FIG. 3, the upper bar 4 can be lodged in the lower part of the upper frame in a housing 6 provided at the surface of one of its faces. This housing can, of course, be provided at any other place of the upper frame or of the upper die holder.

Figure 4:
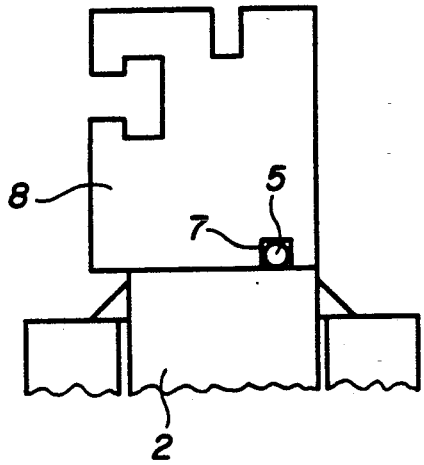
FIG. 4 is a partial section along B—B of the lower frame of the press of FIG. 2.

The lower bar 5 shown in FIG. 4 is arranged in a housing 7 provided in the lower part of the table 8 of the lower frame. This housing can, of course, also be provided at any other place of the lower frame.

I claim:

1. Folding press comprising:

an upper frame and a lower frame, one of the upper and lower frames including at least one deflection means for remedying deficiencies of said upper and lower frames inherent to the folding process, a comparison device for comparing a deflection of each of the frames, said comparison device controlling operation of said deflection means to compensate for a difference in the deflection of said frames, the comparison device including two longitudinal bars arranged, respectively, in longitudinal housing of each of the upper and lower frames, one of the ends of each of the bars being secured to its corresponding housing, the other ends of each bar being free to move longitudinally in their respective housings and being connected to measuring means respectively fixed to each of the upper and lower frames for measuring respective movements of said other ends of the bars in their respective housings for all deflections of the upper and lower frames.

2. Folding press according to claim 1, wherein the comparison device includes the longitudinal bars to allow comparison of elongation of each of the frames when they are deflected.

3. Folding press according to claim 1, wherein the measuring means include linear inductive sensors.

4. Folding press according to claim 1, wherein the measuring means are connected to an electronic device arranged for automatically programming actuation of the deflection means until the difference in deflection of the upper and lower frames is removed.

5. A folding press comprising an upper frame, a lower frame, one of said upper and lower frames at least including deflection means for producing a deflection of at least one portion of at least one of said upper and lower frames, a comparison device including two longitudinal bars arranged, respectively, in longitudinal housings of each of said upper and lower frames, and one of the ends of each of the bars being secured to its respective housing, the other ends of each of the bars being free to move longitudinally in said respective housings and being connected to measuring means respectively fixed to each of the upper and lower frames for measuring respective movements of said other ends of the bars in their respective housings in response to any deflection of said upper and lower frames, said comparison device being arranged for controlling said deflection means to compensate for any difference in deflection of said frames.

6. A folding press according to claim 5, wherein said measuring means include linear inductive sensors.

* * * * *